US005737994A

United States Patent [19]

Escobosa

[11] Patent Number: 5,737,994

[45] Date of Patent: Apr. 14, 1998

[54] DIGITAL VARIABLE ACTUATION SYSTEM

[76] Inventor: Alfonso S. Escobosa, 2034 Brittany Pl., Placentia, Calif. 92670

[21] Appl. No.: 757,854

[22] Filed: Nov. 27, 1996

[51] Int. Cl.[6] ..... F15B 13/16; F15B 13/044

[52] U.S. Cl. ..... 91/361; 91/459

[58] Field of Search ..... 91/459, 361; 60/413, 60/459

[56] References Cited

U.S. PATENT DOCUMENTS

| | | | |
|---|---|---|---|
| 4,759,183 | 7/1988 | Kreth et al. | 91/459 X |
| 4,813,339 | 3/1989 | Uno et al. | 91/459 |
| 4,884,402 | 12/1989 | Strenzke et al. | 91/459 X |
| 5,542,336 | 8/1996 | Larkin | 91/459 X |
| 5,615,594 | 4/1997 | Duckinghaus | 91/459 X |

OTHER PUBLICATIONS

SAE Technical Paper Series "The Integrated Actuation Package Approach to Primary Flight Control", Apr. 1992.

*Primary Examiner*—Hoang Nguyen

[57] ABSTRACT

This invention pertains to a hydrostatic actuation system based on a digitally commutated, piston pump. Typically the pump is a fixed displacement axial piston pump with the hydromechanical commutator (which consists of either check valves or a rotated portplate) replaced by electromagnetically activated switches. The activation of the switches coincides with the extreme position of the pistons. The actual switching events are selected by a digital controller to effect an incremental flow rate to a hydraulic actuator. The flow rate consists of minute volumes of fluid displaced at a frequency and polarity dependent on the magnitude and sign of the rate binary applied to the controller.

2 Claims, 3 Drawing Sheets

DIGITAL VARIABLE ACTUATION SYSTEM

BACKGROUND

1. Field of the Invention

This invention relates to hydrostatic actuation systems that are entirely digital in operation and may be powered by an electric motor.

2. Prior Art

Various analog hydrostatic systems have been conceived to actuate aircraft aerosurfaces, gimbal rocket engine nozzles, steer vehicles, manipulate farm and earth moving equipment, etc. A recent development involves the integration of a fixed speed electric motor, a servo controlled variable delivery piston pump and a hydraulic actuator which falls under the category of electrohydrostatic actuation. Major problems with this particular development are high cost which limits its application to military flight control systems and the lack of inherent fail-safe operation.

OBJECTS AND ADVANTAGES

The object of the invention is a low cost actuation system that has a wide field of application, commercial as well as military. The all digital makeup of the system provides advantages not achievable by the recently developed analog counterparts. Exclusively reserved advantages which will become evident once the makeup and operation of the system is understood, include the following:

1. Immunity to circuit noise and EMI, the result of not needing ADC's and DAC's and other millivolt-level analog circuits.
2. Analytically predictable performance, the result of replacing analog-variable pumping with digital-variable pumping which is not affected by supply and load variations.
3. Testability. Simple processor-oriented, self-test routines suffice.
4. A fully-integrated servoactuator. The all-digital controller can be implemented with two CMOS ASIC's (a processor and a switch driver integrated circuit) which can be imbedded in the pump unit.
5. Reduced energy consumption. Negligible energy is expanded unless the actuator is incremented. Energy is not continuously expanded by the need of a secondary power supply for a pump serve or by the viscous drag and leakage at the pump cylinder body and port plate interface.
6. The ability to operate as a position servo without an actuator position transducer.
7. An inherently fail-safe servoactuator. With the absence of a feedback transducer, primary failures simply result in failure to increment.
8. The ability to parallel-connect redundant channels to a simplex actuator without actively balancing or monitoring their operation in order to instantly switch out the failed channel. A significant weight and complexity reduction results through the elimination of balancing and failure-related hardware as well as the need for a dual tandem actuator.

SUMMARY OF THE INVENTION

In the digital-variable actuation system, the usual hydromechanical commutator of a rotated, fixed-displacement (fixed swashplate angle), axial piston pump is replaced and commutated by electromagnetically-activated, bistable, 3-way switches. The pump requires an even number of evenly spaced pistons, typically four, in order to allow the swashplate to reciprocate the pairs of oppositely positioned pistons in a complementary manner. The non-selectable ports (the pole terminals) of the switches are connected to the output ports of the pump pistons and the two selectable ports (the throw terminals) are connected to the two control chambers of a hydraulic actuator. The activation of the switches, which are selected by a digital controller, are made to coincide with either extreme position of their associated pistons. The activated switch is issued two consecutive switching pulses at the extreme positions of its piston using bipolar switch drivers. The initial pulse applied to the switch switches the pole terminal from the first throw terminal to the second one. The subsequent pulse applied to the switch is applied with reverse polarity and switches the pole terminal from the second throw terminal back to the first throw terminal. Each switching pulse is the result of selecting from among a train of sensor pulses that mark the extreme piston positions. The frequency by which the selection is made is proportional to the magnitude of a binary rate command applied to the controller. The particular selection of the switch to be activated partly depends on the sign bit of the binary rate command which determines the direction the actuator must move. It also depends on whether the activation of that switch results in the appropriate injection (or ejection) of displaced piston fluid into (or from) the selected control chamber so as to effect actuator motion in the commanded direction. With the pair of complementary pistons short-circuited by the two switches prior to activation then, say, injection of fluid into the selected control chamber by the activated switch will also be accompanied by the ejection of fluid from the opposite control chamber through the associated switch. The injected and ejected fluid displaced by the complementary pistons yields a small increment of actuator motion. The subsequent, reverse polarity, switching pulse will again short-circuit the pair of complementary pistons. In this state, the actuator will be held stationary provided, of course, the remaining complementary piston pair(s) are also held in the short-circuited state. The variable frequency in which increments take place and the variable direction in which they step the actuator constitutes digital-variable actuation.

DRAWINGS

SYSTEM DESCRIPTION

Figure 1:
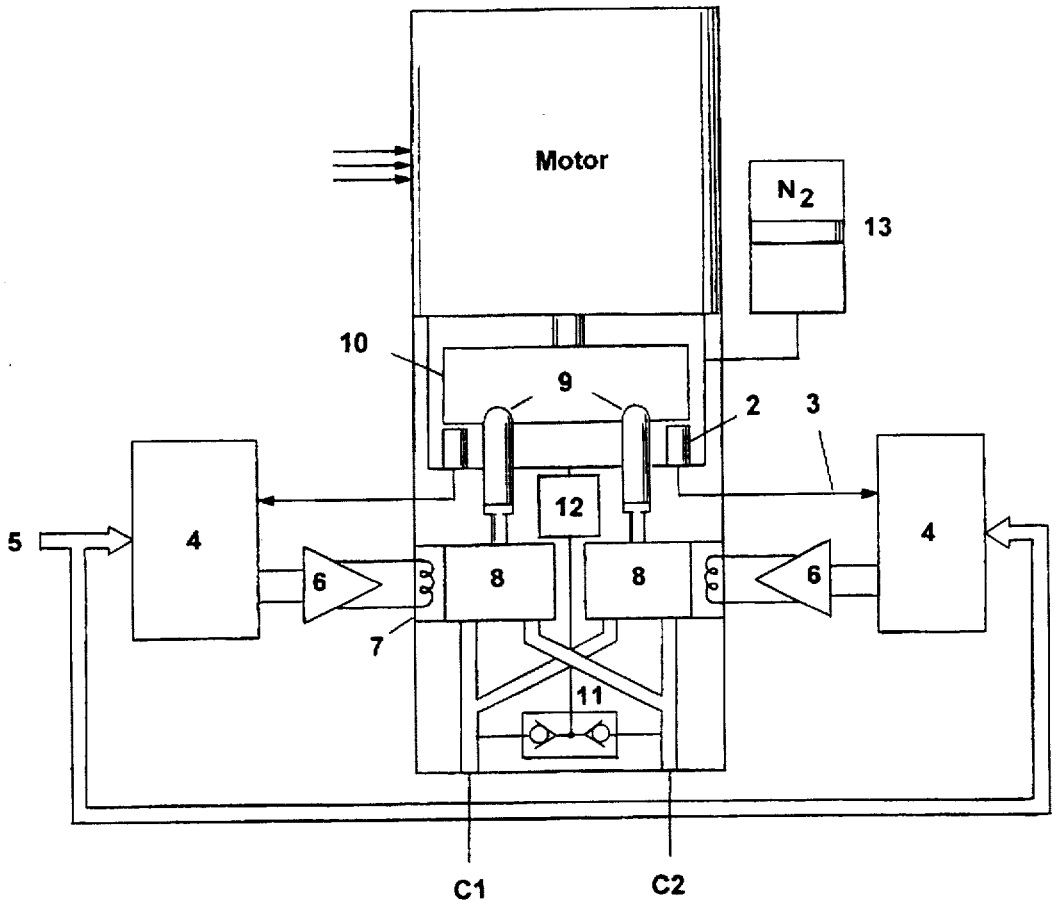
FIG. 1 is a functional diagram of a motor driven axial piston pump wherein the normal portplate commutator is replaced by electromagnetically activated 3-way switches.

FIG. 1 schematically describes a rate control unit consisting, in part, of a motor driven, electromagnetically commutated axial piston pump for the purpose of incrementing a hydraulic actuator at a rate and direction dependent on the magnitude and sign of a binary rate command. The maximum extended positions (TDC) of the pump pistons (9) are sensed by hall effect sensors (2) and the position signaling pulses are applied to a digital rate controller (4). Therein pulses that also signal the maximum retracted position (BDC) of the piston are digitally generated by dividing in half the interval of time between the maximum extension signaling pulses. A binary rate command (5) is also applied to the digital controller where, by means of a binary-to-pulse frequency converter, it selects among all the generated piston position signaling pulses, a number per unit time (a pulse frequency) that is proportional to the magnitude of the binary. The selected train of pulses and the sign bit of the binary rate command are applied to a pulse sequencer where they enable the coincident position signaling pulses (those derived digitally as well as those directly sensed). Each enabled pulse sets an associated flip/flop which is subsequently reset by the opposite generated, piston position signaling pulse. The low-to-high changing complementary outputs of the flip/flops are AND-gated by a timed pulse in order to provide a pulse duration required to properly trigger electromagnetic switches. The resulting pair of timed pulses are then applied to H-bridge configured (bi-polar) switch drivers (6) which power the coils (7) of the 3-way electromagnetic switches (8), the first pulse producing current in one polarity, the second pulse producing current in the opposite polarity. The inter-relations of the binary-to-pulse frequency converter, the pulse sequencer, the pulse timer, and the switch drivers are shown in FIG. 3.

The non-selectable ports (pole terminals) of the 3-way switches are connected to the output ports of the pump pistons and the two selectable ports (throw terminals) are connected to the control chambers of a balanced, bi-directional actuator through control lines C1 and C2, with the first throw terminals connected to one control chamber of the actuator and the second throw terminals connected to the other control chamber. The two pistons are sinusoidally driven by the swash plate assembly (10) 180 degrees out of phase (complementary motion). As such, the first timed pulse applied to the switch driver of an activated switch channels sinusoidally displaced piston fluid from, say, the first throw terminal to the second throw terminal at the start of one-half cycle of sinusoidal piston motion while the second timed pulse restores flow through the first throw terminal at the end of the one-half cycle of piston motion.

The actuator control lines are also connected to back-to-back arranged check valves (11). The inlet connection of the check valves is connected indirectly through filter (12) and the swash plate assembly to the hydraulic reservoir (13). The pressure of the fluid contained between the check valves and the reservoir is set by the gas pressure of the reservoir. During operation of the unit, the check valves prevent the lower pressure of the actuator control lines from falling below the reservoir pressure.

Figure 3:
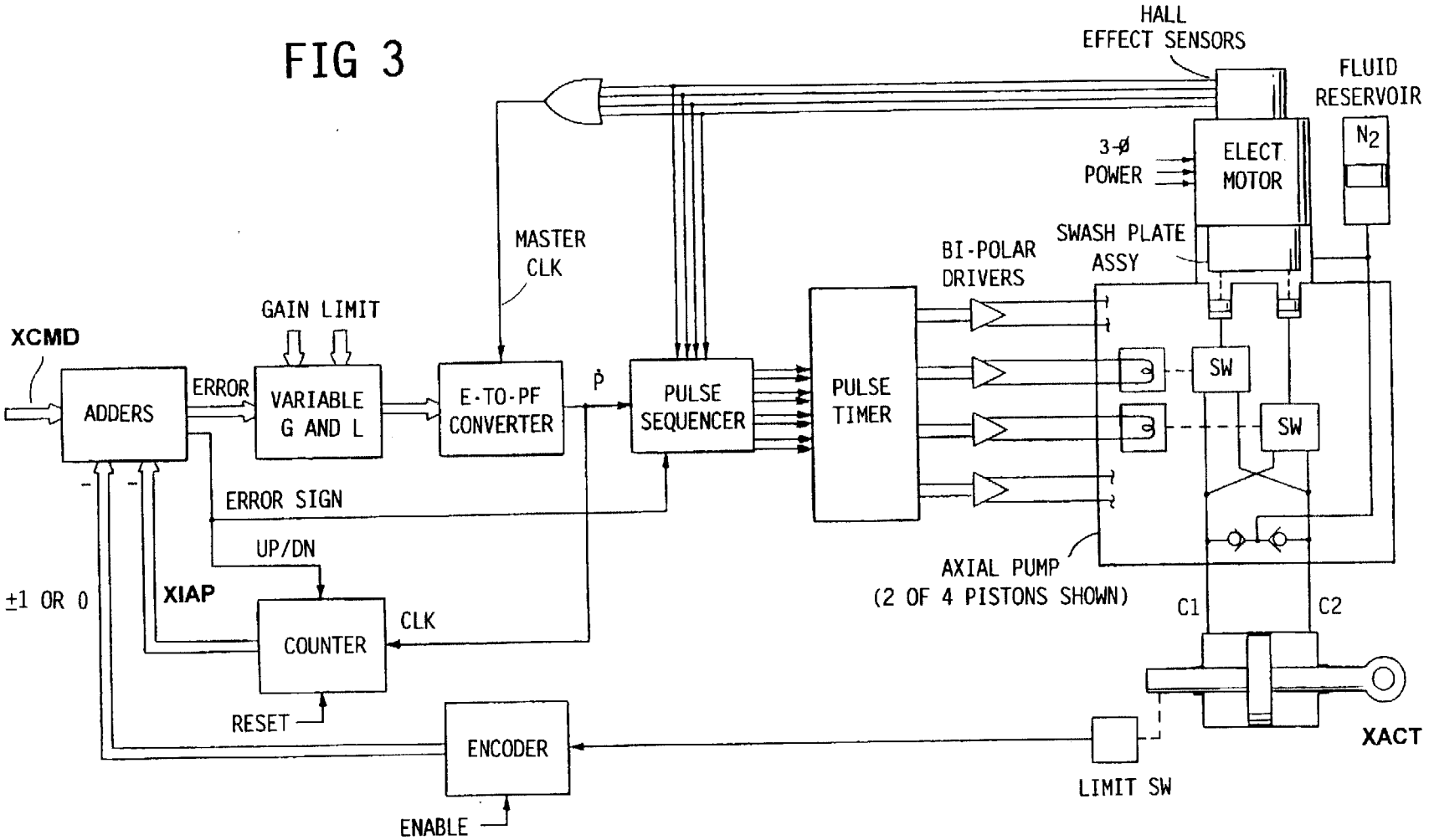
FIG. 3 is an overall diagram of a position servoactuator utilizing the digital-variable hydrostatic pump.

The controllers of FIG. 1 can be integrated into one physical entity as shown in FIG. 3 or may be separate entities as shown. If they are one entity only two hall effect sensors are required to identify the extreme positions of the two complementary driven pistons.

Figure 2:
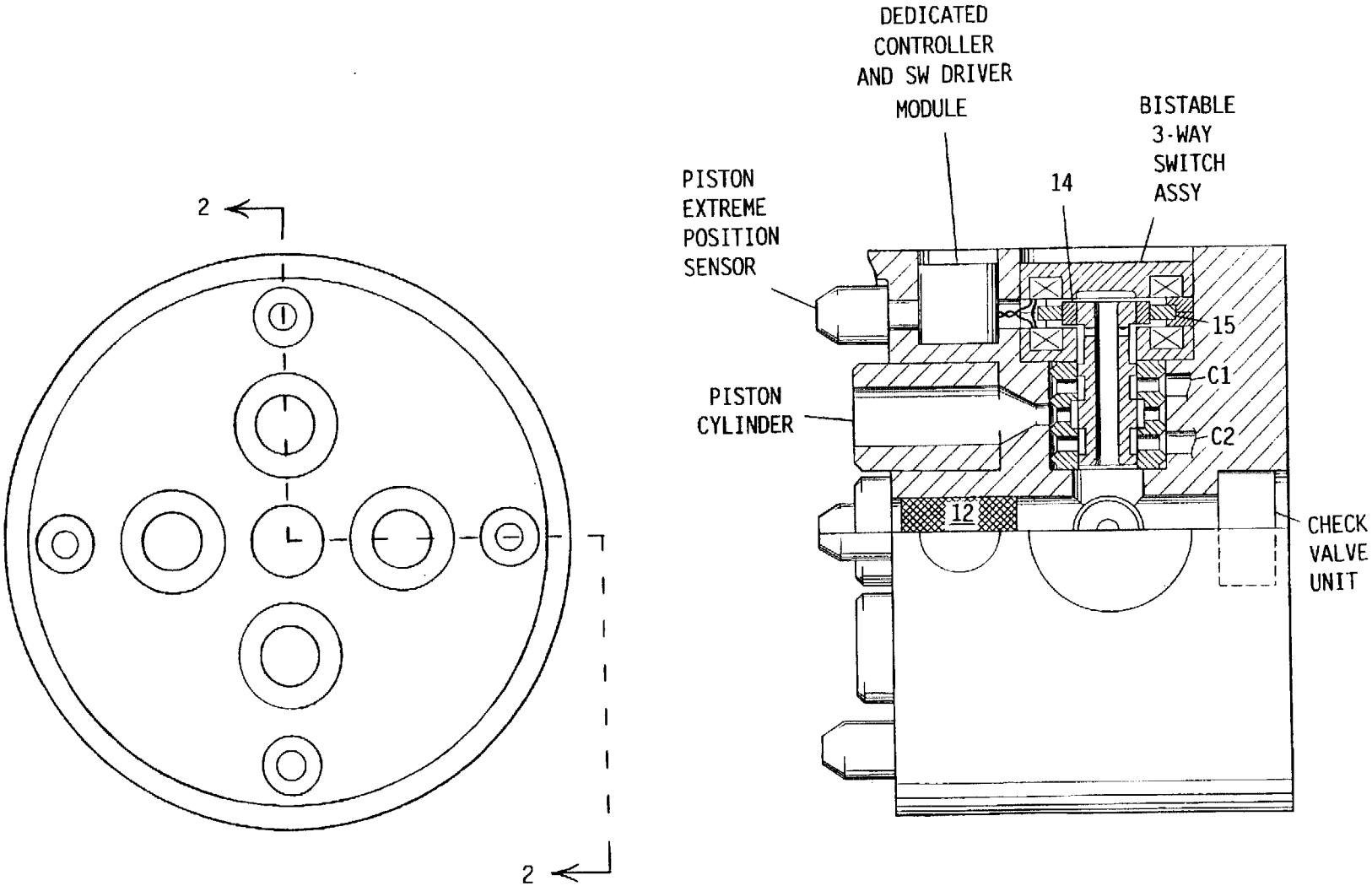
FIG. 2 is a layout of an assembly consisting of four piston cylinders and associated electromagnetically controlled 3-way switches used in a digital-variable hydrostatic pump.

FIG. 2 provides detail of a possible bistable 3-way switch. The switch, which is shown at its mid position, is a 3-way spool valve driven by a bistable electromagnet. The armature of the electromagnet (14) is attached to one end of the spool and interacts with the two stators through and a radially magnetized permanent magnet (15). The magnet is clamped in place between two high permeability rings. The magnet and the two high permeability rings form the shared magnetic circuit of the two stators.

The rate control unit of FIG. 1 forms the basis for manual control of slowly actuated equipment. It also forms the basis for a position servoactuator for flight control of aerospace vehicles.

FIG. 3 shows a first order position servoactuator which incorporates a single entity rate control unit within a single entity position controller. Separate position controller entities, one for each piston may also be used provided the missing pulses that signal the maximum retracted positions of the piston are derived in each controller. The rate command of the unit is now the servo error which is the difference of the commanded actuator position (XCMD) and the indicated actuator position (XIAP). The train of pulses selected by the binary error-to-pulse frequency converter is now also applied to an up/down counter where the pulses are positively or negatively counted according to the sign of the error. The binary output of the counter constitutes the indicated actuator position.

The basic principle of operation using a four piston pump as an example is as follows:

1. The clock required by the error-to-pulse frequency converter is derived from four hall effect sensors that mark the position of the pump at the maximum extensions of the four corresponding pistons. A small angular advance allows the spools time to transition at the actual maximum extension or retraction points which correspond to zero flow rate.
2. The converter generates an output pulse frequency corresponding to the error magnitude by selecting among the incoming pulses. Since the incoming pulses are the four sensor pulses, the feature allows a sequencer to activate the complementary piston pair that is in line for switching.
3. Prior to an incrementation event, the actuator is held stationary by maintaining short circuit connections between each complementary piston pair, complementary motion of each piston pair leaving the actuator control ports open-circuited.
4. Incrementation by a piston pair is initiated by breaking the short circuit connection and is completed by restoring the connection.
5. Which of the two switches is selected to break and restore the connection depends in which direction the actuator is to be incremented and on the piston pair in line for switching. More specifically, it depends on which piston of a pair is already approaching BDC ready to inject fluid into a designated control port (if that is required) or which piston is already approaching TDC ready to eject fluid from the same control port (if that is required).

It may be evident at this point that the actuator can be incremented in either direction by a piston pair using only one switch. Such a system, however, is not preferred for two reasons. First, one switch constitutes loss of redundancy, and therefore the ability to operate in spite of a switch failure. Also, a 50% loss of peak rate (or a 50% loss of resolution if piston displacement is doubled to restore full rate) will result.

There are valid reasons why the servoactuator may be operated without a position transducer. With the train of clock pulses made to clock an up/down counter, the binary output represents the algebraic sum of the minute volumes supplied by the pump to the actuator and, therefore is a close estimate of the actuator position. Specifically, short duration flight control systems of missiles and launch vehicles in which the flight control computer, through its outer loop sensors, has the "final say" as to actuator position, may rely on the counter for inner loop position feedback.

This option also alleviates the problem of fast depletion of compressed gas and hydraulic fluid of blow-down systems where high-frequency, high-intensity nozzle forces strain the thrust vector actuator, often faster than its slew rate can effect correction. In such cases, it is better to decouple the load from the servo by dispensing with the traditional transducer rather that to allow it to waste energy by feeding back unmanageable information.

If operation without a position transducer is chosen for a short duration flight control application, a limit switch (a MSB Encoder) will nevertheless be needed in order to center the actuator prior to normal operation. One way to affect centering is to compose the ± least significant binary representation of the switch output and pass it to the servo adder while the command input and the counter output are cleared to zero. This produces a slow slewing of the actuator toward center. A subsequent limit cycle will announce when centering has been accomplished, after which normal operation can be allowed.

The transducerless concept may also apply to long-duration aircraft flight controls, provided any accumulated discrepancy between the position indicated by the counter (XIAP) and the actual position of the actuator (XACT) does not limit the full scale authority of the command input. This possibility can be prevented with a drift canceling scheme, particularly one that counters drift at the rate that it occurs, without back-stepping. A fail-safe transducerless servoactuator for aircraft use is supported by the fact that drift rates and thus the maximum required cancellation rate are slow. Also since actuation of aerosurfaces is on both sides of trim center, drift is continuously forced toward trim center, and therefore tends to null out with little help from the cancellation scheme. Thus the scheme is not only fail-safe but also partly fail-operational, particularly since the outer loop sensors of the control augmentation system (CAS) compensate for the small reoccurring positive and negatives offsets, not unlike those caused by cross winds, load unbalances, etc.

RAMIFICATIONS

Several variations of the configuration of FIGS. 1, 2 and 3 may be made without deviating from the basic concept of the invention. The following are examples of such variation:

1. The pump may be driven over a wide range of speed.
2. The pump need not be an axial piston pump. A radial piston pump or a pump where in-line piston pairs are driven in complementary manner by a cam may be used.
3. Proximity sensors other than hall effect types may be used to determine either extreme position of a piston.
4. A lower cost, non latching type of electromagnet is possible by eliminating the ring magnet shown in FIG. 2 and replacing the entire center core with a single high permeability ring.
6. The limit switch and the up/down counter shown in FIG. 3 may be replaced by a position transducer. A digital position encoder which is compatible with the all digital controller is preferred.
7. If, in an aircraft flight control application, a high degree of accuracy is desired but the use of a position transducer is not, a digital drift error cancellation scheme may be incorporated in the controller. One possible scheme replaces the limit switch with a gray-coded 4-bit encoder (a 15 position marker) and requires the addition of logic elements to the controller that performs the following tasks:
   a. The algebraic differences between the counter-indicated position (XIAP) and the encoder indicated position (XACT) are computed and recorded at each bit transition of the encoder. Elapsed times between transitions are also measured and recorded.
   b. From the recorded data, drift rates are repeatedly computed and converted to a pulse frequency using a dedicated rate to pulse frequency converter.
   c. The generated drift pulses along with the generated servo pulses are fed back to the XIAP counter through a queuing gate such that if their signs agree both pulses are gated to the clock input, but it their signs differ, the pulse that is preceded by two or more of the other source pulses is inhibited as is the first, subsequently encountered other source pulse.

The purpose of the particular gating of the counter clocks is to prevent back-stepping which conserves energy.

The above procedure which is repeated at each bit transition of the encoder may incorporate the averaging of recorded data of several past transitions. With continued actuation through transition points any discrepancy that may develop should be attenuated to an insignificant magnitude.

I claim the following:

1. A digital-variable actuation system based on a motor driven piston pump, said pump composed of at least one pair of complementary pistons with the output ports of each pair of pistons commutated by two 3-way electromagnetic bistable switches; pole terminals of the switches connected to said output ports, first throw terminals of the two switches connected to one control chamber of a hydraulic actuator and second throw terminals of the switches connected to the opposite control chamber of the actuator; a stationary holding of the actuator position accomplished by a connection between all the first throw terminals to all the second throw terminals, said connection effected with either switch of the complementary pairs of pistons and said connection shorting the output ports of the associated complementary pistons; one incrementation of the actuator initiated by opening the shorting connection with either switch at the instant its associated piston reaches the maximum extended or retracted position, the incrementation terminated by restoring the shorting connection with the same switch at the instant the associated piston reaches the opposite extreme position, the actuator thereafter again held stationary; the selection of a particular switch for the breaking and resorting of the shorting connection required for one incrementation of the actuator dependent in which direction the actuator is to be incremented and on the relative positions of the complementary pistons in line for switching.

2. The digital-variable actuation system of claim 1 wherein the control of the 3-way electromagnetic bistable switches is performed by a digital controller incorporating an input binary and an input train of sensor-generated pulses that mark the extreme positions of the pistons; a number of pulses selected by the controller from among the sensor-generated pulses at a frequency that is proportional to the magnitude of the input binary, the train of selected pulses, once timed and power-amplified, directed to the system 3-way switches to increment the actuator in the direction designated by a sign bit of the input binary, the state of the switches otherwise maintaining shorting connections of the associated complementary piston pairs which holds the position of the actuator.

* * * * *